US006716804B2

(12) United States Patent
Scherubel

(10) Patent No.: US 6,716,804 B2
(45) Date of Patent: Apr. 6, 2004

(54) CLEANER/DEGREASER COMPOSITIONS WITH SURFACTANT COMBINATION

(75) Inventor: Gary Scherubel, St. Louis, MO (US)

(73) Assignee: Buckeye International, Inc., Maryland Heights, MO (US)

( * ) Notice: Subject to any disclaimer, the term of this patent is extended or adjusted under 35 U.S.C. 154(b) by 0 days.

(21) Appl. No.: 10/218,878

(22) Filed: Aug. 14, 2002

(65) Prior Publication Data

US 2004/0033920 A1 Feb. 19, 2004

(51) Int. Cl.[7] ..... C11D 17/00

(52) U.S. Cl. ..... 510/245; 510/421; 510/490; 510/499; 510/505; 510/506

(58) Field of Search ..... 510/237, 245, 510/278, 490, 421, 492, 505, 506

(56) References Cited

U.S. PATENT DOCUMENTS 6,090,762 A * 7/2000 Clapperton et al. ..... 510/108
6,462,014 B1 * 10/2002 Johnson et al. ..... 510/504
2003/0148905 A1 * 8/2003 Motson ..... 510/201

* cited by examiner

*Primary Examiner*—Necholus Ogden
(74) *Attorney, Agent, or Firm*—Senniger, Powerw, Leavitt & Roedel

(57) ABSTRACT

A cleaner or degreaser composition with enhanced performance characteristics comprises a surfactant combination consisting of a) a water soluble ethoxylate selected from the group consisting of at least one linear primary or branched secondary alcohol of $C_9$ to $C_{15}$ chain length and 6 to 13 ethylene oxide groups/mole of alcohol; b) a water insoluble ethoxylate selected from the group consisting of at least one linear primary or branched secondary alcohol of $C_9$ to $C_{15}$ chain length and 2.5 to 5 ethylene oxide groups/mole of alcohol; and c) a component selected from the group consisting of amphoteric surfactants, couplers and mixtures thereof; the composition containing alkylphenol ethoxylate or glycol ether solvent.

17 Claims, No Drawings

CLEANER/DEGREASER COMPOSITIONS WITH SURFACTANT COMBINATION

BACKGROUND OF THE INVENTION

This invention relates to cleaner/degreaser compositions and, more particularly, to such compositions comprising a novel surfactant combination which provide enhanced performance characteristics.

Heretofore, cleaners and degreasers containing nonylphenol ethoxylate surfactants have been known and used. However, environmental concerns have been raised concerning the use of such surfactants. Additionally, concerns have been expressed concerning the use of ethylenediamine tetraacetic acid chelants in such cleaners and degreasers. Replacement of nonylphenol ethoxylate surfactants with linear alcohol ethoxylates has been considered, but such substitutions in cleaners and degreasers with these ingredients has caused the performance thereof to suffer.

There is a need therefore for cleaner/degreaser compositions which contain no alcohol, alkylphenol ethoxylate or glycol ether solvent but which exhibits performance characteristics equal to or exceeding the performance of their nonylphenol ethoxylate counterparts.

SUMMARY OF THE INVENTION

Among the several objects of the invention may be noted the provision of cleaner or degreaser compositions containing no alcohol, alkylphenol ethoxylate or glycol ether solvent; the provision of such compositions which provide enhanced performance characteristics as compared to compositions containing alkylphenol ethoxylate surfactants; and the provision of such compositions which contain a novel surfactant combination together with an amphoteric surfactant or a coupler or both. Other objects and features will be in part apparent and in part pointed out hereinafter.

Briefly, the present invention is directed to a cleaner or degreaser composition comprising a surfactant combination consisting of (a) a water soluble ethoxylate selected from the group consisting of at least one linear primary or branched secondary alcohol of $C_9$ to $C_{15}$ chain length and 6 to 13 ethylene oxide groups/mole of alcohol; (b) a water insoluble ethoxylate selected from the group consisting of at least one linear primary or branched secondary alcohol of $C_9$ to $C_{15}$ chain length and 2.5 to 5 ethylene oxide groupsimoie of alcohol; and (c) a component selected from the group consisting of amphoteric surfactants, couplers and mixtures thereof; the composition containing no alcohol, alkylphenol ethoxylate or glycol ether solvent. It has been found that the use of this particular surfactant combination improves the performance of such cleaner or degreaser compositions so that they are equal to or exceed the performance of counterpart cleaners and degreasers containing nonylphenol ethoxylate surfactants.

DESCRIPTION OF THE PREFERRED EMBODIMENTS

In carrying out the invention, the first component of the surfactant combination of the invention is a water soluble ethoxylate selected from the group consisting of at least one linear primary or branched secondary alcohol of $C_9$ to $C_{15}$ chain length and 6 to 13 ethylene oxide groups/mole of alcohol. Among the specific water soluble ethoxylates which may be used in the practice of the invention may be mentioned Neodol 1-9 (a soluble $C_{11}$ linear alcohol oxide), Neodol 91-6 (a soluble $C_{9-11}$ linear alcohol with 6 moles of ethylene oxide), Neodol 91-8 (a soluble $C_{12-13}$ linear alcohol with 8 moles of ethylene oxide), Neodol 23-6.5 (a soluble $C_{12-13}$ linear alcohol with 6.5 moles of ethylene oxide), Neodol 25-9 (a soluble $C_{12-15}$ linear alcohol with 9 moles of ethylene oxide) and Neodol 45-13 (a soluble $C_{14-15}$ linear alcohol with 13 moles of ethylene oxide). These Neodol surfactants are all available from Shell Chemical Company. Other water soluble ethoxylates useful in the present invention include Tergitol 15-S-9 (a soluble secondary alcohol ethoxylate having the formula $C_{12-14}H_{25-29}O(CH_2CH_2O)_xH$ wherein x is 9 moles of ethylene oxide) and Tergitol 15-S-12 (a soluble secondary alcohol ethoxylate of the above formula wherein x is 12 moles of ethylene oxide). These Tergitol products are available from Union Carbide. Also useful is Surfonic L24-9 (a water soluble ethoxylate from Huntsman of linear, primary alcohol of $C_{12-14}$ chain length and 9 moles of ethylene oxide).

It will be understood that other water soluble ethoxylates consisting of at least one linear primary or branched secondary alcohol of $C_9$ to $C_{15}$ chain length and 6 to 13 ethylene oxide groups/mole of alcohol known to those skilled in the art may also be used in the practice of the invention.

The second component of the cleaner or degreaser compositions of the invention is a water insoluble ethoxylate selected from the group consisting of at least one linear primary or branched secondary alcohol of $C_9$ to C15 chain length and 2.5 to 5 ethylene oxide groups/mole of alcohol. Exemplary water insoluble ethoxylates of this type for use in the present invention include Neodol 1-3 (an insoluble $C_{11}$ linear alcohol with 3 moles of ethylene oxide), Neodol 91-2.5 (an insoluble $C_{9-11}$linear alcohol with 2.5 moles of ethylene oxide), Neodol 1-5 (an insoluble $C_{11}$ linear alcohol with 5 moles of ethylene oxide), Neodol 23-3 (an insoluble $C_{12-13}$ linear alcohol with 3 moles of ethylene oxide), Neodol 25-3 (an insoluble $C_{12-15}$linear alcohol with 3 moles of ethylene oxide), Neodol 45-2.5 (an insoluble $C_{14-15}$ linear alcohol with 2.5 moles of ethylene oxide), and Tergitol 15-S-3 (an insoluble secondary alcohol ethoxylate with 3 moles of ethylene oxide).

It will be understood that other water insoluble ethoxylates consisting of at least one linear primary or branched secondary alcohol of $C_9$ to $C_{15}$ chain length and 2.5 to 5 ethylene oxide groups/mole of alcohol known to those skilled in the art may also be used in the practice of the invention.

The third component of the cleaner or degreaser compositions of the invention is an amphoteric surfactant, a coupler or a mixture of an amphoteric surfactant and a coupler. Among the amphoteric surfactants which may be employed are isodecyloxypropylimino dipropionic acid monosodium salt (sold under the trade designation "Alkali Surfactant NM" by Tomah Products, Inc.), sodium iminodipropionate (sold under the trade designation "Amphoteric 400" by Tomah Products, Inc.), an alkylether hydoxypropyl sultaine (marketed under the trade designation "Mirataine ASC" by Rhodia), sodium 2-ethylhexyl sulfate and sodium diisopropylnaphthalenesulfonate (marketed under the trade designation "Naxan DSL" by Rutgers). Other amphoteric surfactants which may be utilized include cocamidopropyl betaine, sodium palmityloamphopropionate, disodium N-lauryliminodipropionate and sodium coco imidazoline amphoglycinate. The use of "Alkali Surfactant NM" mentioned above is preferred.

Various couplers known to the art may also be used in the practice of the invention including isononanoic acid, sodium cumene sulfonate, sodium xylene sulfonate, sodium benzene sulfonate, sodium toluene sulfonate, potassium ethylbenzene sulfonate, sodium octane-1-sulfonate, ammonium xylene sulfonate, sodium-2-ethylhexonoate, sodium pelargonate and disodium capryloiminodipropionate. Other couplers known to those skilled in the art may also be employed. Isononanoic acid is the preferred coupler for use in the present invention.

While the compositions of the invention may be prepared using either an amphoteric surfactant or a coupler as the third component, it is preferred to use a mixture of an amphoteric surfactant and a coupler. More specifically, the use of a mixture of "Alkali Surfactant NM" as the amphoteric surfactant and isononanoic acid as the coupler is preferred.

The compositions of the invention may contain various proportions of the three components. In general, it is preferred that the weight percent of the water soluble ethoxylate in the composition be less than twice the weight percent of the water insoluble ethoxylate. Further, in a preferred embodiment of the invention, the composition contains three parts by weight of the water soluble ethoxylate component to two parts by weight of the water insoluble ethoxylate component.

It is important that the compositions of the invention contain substantially no alcohol, alkylphenol ethoxylate (e.g. nonylphenol ethoxylate) or glycol ether solvent. As shown by the working examples set forth hereinafter, the performance characteristics of the cleaner or degreaser compositions of the invention are enhanced by the novel surfactant combination utilized in the practice of the invention. This enhancement is achieved without raising environmental concerns.

The following examples illustrate the practice of the invention.

EXAMPLE 1

The following cleaner or degreaser compositions were prepared:

| Product Component | 3-56 | 3-89 | 4-19 | 4-24 | 4-25 | 4-26 | 4-33 | 4-34 | 4-47 | 4-48 | 5-38 |
|---|---|---|---|---|---|---|---|---|---|---|---|
| Soft Water | 87.596 | 85.796 | 85.796 | 88.796 | 86.596 | 89.596 | 88.796 | 88.796 | 88.796 | 87.796 | 88.646 |
| Na Metasilicate | 0.2 | 2.0 | 2.0 | 2.0 | 0.2 | 0.2 | 2.0 | 2.0 | 2.0 | 2.0 | 2.0 |
| 50% Sodium Hydroxide | 0.5 | 0.5 | 0.5 | 0.5 | 0.5 | 0.5 | 0.5 | 0.5 | 0.5 | 0.5 | 0.5 |
| Hampene 100S Nalminodisuccinate | 2.0 | 2.0 | 2.0 | 2.0 | 2.0 | 2.0 | 2.0 | 2.0 | 2.0 | 2.0 | 2.0 |
| Trielhanolamine | 0.4 | 0.4 | 0.4 | 0.4 | 0.4 | 0.4 | 0.4 | 0.4 | 0.4 | 0.4 | 0.4 |
| Alkali Surfactant NM | 1.0 | 1.0 | 1.0 | 1.0 | 1.0 | 1.0 | 1.0 | 1.0 | 1.0 | 1.0 | 1.0 |
| Dowanol DPnB | 5.0 | 5.0 | 3.0 | — | 3.0 | — | — | — | — | — | — |
| Tergitol NP-11 | — | — | — | — | — | — | — | — | — | — | — |
| Surfonic L24-9 | 3.0 | 3.0 | 3.0 | 3.0 | 3.0 | 3.0 | — | — | — | — | — |
| Aq. $NH_3$ 30% | 0.2 | 0.2 | 0.2 | 0.2 | 0.2 | 0.2 | 0.2 | 0.2 | 0.2 | 0.2 | 0.2 |
| Neodol 1-9 | — | — | — | — | — | — | 3.0 | 3.0 | — | — | 3.0 |
| Neodol 1-3 | — | — | 2.0 | 2.0 | 2.0 | 3.0 | 2.0 | — | — | — | 2.0 |
| Isononanoic Acid | — | — | — | — | — | — | — | — | — | — | 0.25 |
| Citrosyn | 0.1 | 0.1 | 0.1 | 0.1 | 0.1 | 0.1 | 0.1 | 0.1 | 0.1 | — | — |
| Green S-310 | 0.0027 | 0.0027 | 0.0027 | 0.0027 | 0.0027 | 0.0027 | 0.0027 | 0.0027 | 0.0027 | 0.0027 | 0.0027 |
| Allzarine Fast Blue RB | 0.0013 | 0.0013 | 0.0013 | 0.0013 | 0.0013 | 0.0013 | 0.0013 | 0.0013 | 0.0013 | 0.0013 | 0.0013 |
| Neodol 25-3 | — | — | — | — | — | — | — | 2.0 | 2.0 | — | — |
| Neodol 25-12 | — | — | — | — | — | — | — | — | 3.0 | — | — |
| Neodol 45-2.25 | — | — | — | — | — | — | — | — | — | 2.0 | — |
| Neodol 45-13 | — | — | — | — | — | — | — | — | — | 4.0 | — |

In the above compositions, Hampene 100S is a chelating agent, Alkali Sufactant NM is isodecyloxypropylimino dipropionic acid monosodium salt, Dowanol DpnB is dipropylene glycol mono-n-butyl ether, Tergitol NP-11 is nonylphenol ethoxylate, Surfonic L24-9 is a soluble linear alcohol ethoxylate, Neodol 1-9 is a soluble $C_{11}$ linear alcohol with 9 moles of ethylene oxide, Neodol 1-3 is an insoluble $C_{11}$ linear alcohol with 3 moles of ethylene oxide, Citrosyn is a perfume, Green 5-310 is a colorant, Neodol 25-3 is an insoluble $C_{12-15}$ linear alcohol with 3 moles of ethylene oxide, Neodol 25-12 is a soluble $C_{12-15}$ linear alcohol with 12 moles of ethylene oxide, Neodol 45-2.25 is an insoluble $C_{14-15}$ linear alcohol with 2.25 moles of ethylene oxide and Neodol 45-13 is an insoluble $C_{14-15}$ linear alcohol with 13 moles of ethylene oxide.

EXAMPLE 2

The compositions of Example 1 and a composition commercially available under the trade designation "XL-100" (Buckeye International, Inc.) were subjected to the following procedures to determine their capacity for cleaning tile and removing soil.

Tile and Tile Preparation

12"×12" tiles were cut from Masonite board. The whiteness of the board is determined using a Mini Scan XE Plus made by Hunter Lab. The whiteness is determined as an "L" value which measures gradations between white and black. Ten measurements were made on different parts of the board and averaged.

The tile was then soiled with various soils (CSMA, AATCC and Soot) or one particular soil (CSMA), using a Gardner Straight Line Washability and Abrasion Machine. The machine was modified to use a weighted block having a "Water Wiz Application Pad" attached to the bottom. This pad was first soiled with an amount of desired soil, then placed on the tile and moved back and forth along the tile until the desired amount of soiling was achieved. The degree of soiling was measured using the Mini Scan; measuring five places along the soiled path and averaging.

Cleaning Tile and Measuring Soil Removed

The soiled tile was then cleaned with the compositions of Example 1 diluted to the desired strength, while also running a control. The cleaning was done using a Gardner Washability and Wear Tester. After cleaning, the tile was dried. The amount of soil removed was determined by first measuring the cleaned area for whiteness again with the Mini Scan. Initial soil was measured by taking the difference between the average for the tile and the average after soiling. Soil remaining was calculated by taking the difference between the average for the tile and the average for the cleaned portion. Soil removal was calculated by subtracting initial soil from soil remaining. The % soil removal was calculated by dividing soil removed by initial soil.

The results of these tests on the compositions of Example 1 and on XL-100 are as follows:

| 12 oz/gal | % Soil Removed | | |
|---|---|---|---|
| Product | CSMA | AATCC | Soot |
| XL-100 | 43.46 | 66.18 | 74.56 |
| 3-56 | 39.53 | 57.45 | 58.94 |
| 3-89 | 57.71 | 69.16 | 57.41 |
| XL-100 | 45.96 | 70.52 | 85.63 |
| 4-25 | 40.06 | 69.47 | 80.40 |
| 4-26 | 42.22 | 64.39 | 80.94 |
| 4-19 | 46.02 | 69.90 | 83.52 |
| XL-100 | 37.92 | 79.58 | 85.17 |
| 3-89 | 48.1O | 72.55 | 85.19 |
| 4-24 | 44.61 | 77.60 | 87.93 |
| 4-33 | 45.60 | 79.06 | 89.52 |
| 4-34 | 41.54 | 79.69 | 85.52 |
| XL-100 | 35.88 | 77.18 | 85.33 |
| 4-33 | 37.69 | 79.72 | 84.52 |
| 4-47 | 39.38 | 79.76 | 81.08 |
| 4-48 | 39.57 | 75.19 | 77.12 |

CSMA Soil Removal Test

| 12 oz/gal | % Soil Removed | |
|---|---|---|
| Product | CSMA-Lt | CSMA-Hv |
| XL-100 | 60.69 | 11.85 |
| 5-38 | 82.35 | 32.25 |

EXAMPLE 3

The following cleaner/degreaser compositions were prepared:

| | Product | | |
|---|---|---|---|
| Component | 2-6A | 4-85 | 5-34 |
| Water | 85.739 | 85.823 | 85.391 |
| Brilliant Blue 59 | 0.0020 | 0.0020 | 0.0020 |
| Triton X-100 | — | — | — |
| Surfonic L24-9 | 6.084 | — | — |
| Neodol 1-9 | — | 3.0 | 3.0 |
| Neodol 1-3 | — | 2.0 | 2.0 |
| Alkali Surfactant NM | — | 1.0 | 1.0 |
| Isononanoic acid | — | — | 0.5 |
| Hampene 100S | — | — | — |
| Liq. Gluconate 60 | 5.0 | 5.0 | — |
| Sod. iminodisuccinate | — | — | 5.0 |
| Sodium borate | 2.0 | — | 2.0 |
| Triethanolamine | 0.5020 | 0.5020 | 0.5020 |
| Sodium nitrite | 0.6050 | 0.6050 | 0.6050 |
| 75% Phosphoric Acid | — | — | — |
| Citrosyn | 0.068 | 0.068 | — |

These compositions and a composition commercially available under the trade designation "Blue" (Buckeye International, Inc.) were subjected to the soil removal tests set forth in Example 2 with the following results:

| 2 oz/gal | % Soil Removed | |
|---|---|---|
| Product | CSMA-Lt | CSMA-Hv |
| Blue | 61.26 | 50.98 |
| 2-6A | 60.39 | 44.31 |
| 4-85 | 65.85 | 64.43 |
| 5-34 | 80.03 | 59.17 |

EXAMPLE 4

The following cleaner/degreaser composition was prepared:

| Component | Product 6-47 |
|---|---|
| Soft Water | 91.976 |
| Sodium Nitrite | 0.2500 |
| Hampene 100S | — |
| Sod. iminodisuccinate | 1.4 |
| Hampene DEG | — |
| Sodium borate | 2.4 |
| Tergitol NP-11 | — |
| T-Det N-9.5 | — |
| Alkali Surfactant NM | 0.67 |
| Neodol 1-3 | 1.3 |
| Neodol 1-9 | 2.25 |
| Citric Acid | 0.4000 |
| Pylaklor Red S-552 | 0.0040 |

The above composition and a composition commercially available under the trade designation "Straight UP" (Buckeye International, Inc.) were subjected to the soil removal test set forth in Example 2 with the following results:

| 3 oz/gal | % Soil Removed | |
|---|---|---|
| Product | CSMA-Lt | CSMA-Hv |
| Straight Up | 85.88 | 51.49 |
| 6-47 | 89.44 | 70.57 |

EXAMPLE 5

The following cleaner/degreaser composition were prepared:

| Product | Formulations | | | | | | | | | |
|---|---|---|---|---|---|---|---|---|---|---|
| Component | 8-108 | 8-108A | 8-109 | 8-110 | 8-110A | 8-111 | 8-111A | 8-112 | 8-112A | 8-113 |
| Tap Water | 85.391 | 85.391 | 85.391 | 85.391 | 85.391 | 85.391 | 85.391 | 85.391 | 85.391 | 85.391 |
| Brilliant Blue 59 | 0.002 | 0.002 | 0.002 | 0.002 | 0.002 | 0.002 | 0.002 | 0.002 | 0.002 | 0.002 |
| Neodol 1-9 | 3.0 | 2.0 | 4.0 | 2.0 | 4.0 | 3.0 | 3.0 | — | — | — |
| Neodol 1-3 | 2.0 | 3.0 | 1.0 | 2.0 | 2.0 | 1.0 | 3.0 | 2.0 | 2.0 | 2.0 |
| Alkali Surfactant NM | 1.0 | 1.0 | 1.0 | 2.0 | — | 2.0 | — | 1.0 | 1.0 | 1.0 |
| Isononanoic Acid | 0.5 | 0.5 | 0.5 | 0.5 | 0.5 | 0.5 | 0.5 | 0.5 | 0.5 | 0.5 |
| Sodium Borate | 2.0 | 2.0 | 2.0 | 2.0 | 2.0 | 2.0 | 2.0 | 2.0 | 2.0 | 2.0 |
| Sodium iminodisuccinate | 5.0 | 5.0 | 5.0 | 5.0 | 5.0 | 5.0 | 5.0 | 5.0 | 5.0 | 5.0 |
| Sodium nitrate | 0.6050 | 0.6050 | 0.6050 | 0.6050 | 0.6050 | 0.6050 | 0.6050 | 0.6050 | 0.6050 | 0.6050 |
| Triethanolamine | 0.5020 | 0.5020 | 0.5020 | 0.5020 | 0.5020 | 0.5020 | 0.5020 | 0.5020 | 0.5020 | 0.5020 |
| Neodol 91-6 | — | — | — | — | — | — | — | 3.0 | — | — |
| Neodol 91-8 | — | — | — | — | — | — | — | — | 3.0 | — |
| Neodol 23-6.5 | — | — | — | — | — | — | — | — | — | 3.0 |
| Neodol 25-9 | — | — | — | — | — | — | — | — | — | — |
| Neodol 45-13 | — | — | — | — | — | — | — | — | — | — |
| Neodol 1-5 | — | — | — | — | — | — | — | — | — | — |
| Neodol 91-2.5 | — | — | — | — | — | — | — | — | — | — |
| Neodol 23-3 | — | — | — | — | — | — | — | — | — | — |
| Neodol 25-3 | — | — | — | — | — | — | — | — | — | — |
| Neodol 45-2.5 | — | — | — | — | — | — | — | — | — | — |
| Tergitol 15-S-9 | — | — | — | — | — | — | — | — | — | — |
| Tergitol 15-S-12 | — | — | — | — | — | — | — | — | — | — |
| Tergitol 15-S-3 | — | — | — | — | — | — | — | — | — | — |

| Product | Formulations | | | | | | | | | |
|---|---|---|---|---|---|---|---|---|---|---|
| Component | 8-113A | 8-113B | 8-114 | 8-114A | 8-115 | 8-115A | 8-115B | 8-118 | 8-119 | 8-120 |
| Tap Water | 85.391 | 85.391 | 85.391 | 85.391 | 85.391 | 85.391 | 85.391 | 85.391 | 85.391 | 85.391 |
| Brilliant Blue 59 | 0.002 | 0.002 | 0.002 | 0.002 | 0.002 | 0.002 | 0.002 | 0.002 | 0.002 | 0.002 |
| Neodol 1-9 | — | — | 3.0 | 3.0 | 3.0 | 3.0 | 3.0 | — | — | 2.0 |
| Neodol 1-3 | 2.0 | 2.0 | — | — | — | — | — | 2.0 | 2.0 | — |
| Alkali Surfactant NM | 1.0 | 1.0 | 1.0 | 1.0 | 1.0 | 1.0 | 1.0 | 1.0 | 1.0 | 1.0 |
| Isononanoic Acid | 0.5 | 0.5 | 0.5 | 0.5 | 0.5 | 0.5 | 0.5 | 2.0 | 2.0 | 2.0 |
| Sodium Borate | 2.0 | 2.0 | 2.0 | 2.0 | 2.0 | 2.0 | 2.0 | 5.0 | 5.0 | 5.0 |
| Sodium iminodisuccinate | 5.0 | 5.0 | 5.0 | 5.0 | 5.0 | 5.0 | 5.0 | 5.0 | 5.0 | 5.0 |
| Sodium nitrate | 0.6050 | 0.6050 | 0.6050 | 0.6050 | 0.6050 | 0.6050 | 0.6050 | 0.6050 | 0.6050 | 0.6050 |
| Triethanolamine | 0.5020 | 0.5020 | 0.5020 | 0.5020 | 0.5020 | 0.5020 | 0.5020 | 0.5020 | 0.5020 | 0.5020 |
| Neodol 91-6 | — | — | — | — | — | — | — | — | — | — |
| Neodol 91-8 | — | — | — | — | — | — | — | — | — | — |
| Neodol 23-6.5 | — | — | — | — | — | — | — | — | — | — |
| Neodol 25-9 | 3.0 | — | — | — | — | — | — | — | — | — |
| Neodol 45-13 | — | 3.0 | — | — | — | — | — | — | — | — |
| Neodol 1-5 | — | — | 2.0 | — | — | — | — | — | — | — |
| Neodol 91-2.5 | — | — | — | 2.0 | — | — | — | — | — | — |
| Neodol 23-3 | — | — | — | — | 2.0 | — | — | — | — | — |
| Neodol 25-3 | — | — | — | — | — | 2.0 | — | — | — | — |
| Neodol 45-2.5 | — | — | — | — | — | — | 2.0 | — | — | — |
| Tergitol 15-S-9 | — | — | — | — | — | — | — | 3.0 | — | — |
| Tergitol 15-S-12 | — | — | — | — | — | — | — | — | 3.0 | — |
| Tergitol 15-S-3 | — | — | — | — | — | — | — | — | — | 2.0 |

In the above formulations, Neodol 1-9 is a soluble $C_{11}$ linear alcohol with 9 moles of ethylene oxide, Neodol 1-3 is an insoluble $C_{11}$ linear alcohol with 3 moles of ethylene oxide, Neodol 91-6 is a soluble $C_{9-11}$ linear alcohol with 6 moles of ethylene oxide Neodol 91-8 is a soluble $C_{9-11}$ linear alcohol with 8 moles of ethylene oxide, Neodol 23-4.5 is a soluble $C_{12-13}$ linear alcohol with 6.5 moles of ethylene oxide, Neodol 25-9 is a soluble $C_{12-15}$ linear alcohol with 9 moles of ethylene oxide, Neodol 45-13 is a soluble $C_{14-15}$ linear alcohol with 13 moles of ethylene oxide, Neodol 1-5 is an insoluble $C_{11}$ linear alcohol with 5 moles of ethylene oxide, Neodol 91-2.5 is an insoluble $C_{9-11}$ linear alcohol with 2.5 moles of ethylene oxide, Neodol 23-3 is an insoluble $C_{12-13}$ linear alcohol with 3 moles of ethylene oxide, Neodol 25-3 is an insoluble $C_{12-15}$ linear alcohol with 3 moles of ethylene oxide, Neodol 45-2.5 is an insoluble $C_{14-15}$ linear alcohol with 2.5 moles of ethylene oxide, Tergitol 15-S-9 is a secondary alcohol ethoxylate having the formula $C_{12-14}H_{25-29}O(CH_2CH_2O)_xH$ wherein x is 9 moles of ethylene oxide, Tergitol 15-S-12 is a secondary alcohol ethoxylate as above wherein x is 12 moles of ethylene oxide and Tergitol 15-S-3 is a secondary alcohol ethoxylate as above wherein x is 3 moles of ethylene oxide.

The above formulations were subjected to the soil removal tests of Example 2 with the following results:

| 2 oz/gal | % Soil Removed | |
|---|---|---|
| Product | CSMA-Lt | CSMA-Hv |
| 8-108 | 85.34 | 65.48 |
| 8-108A | 81.43 | 75.56 |
| 8-109 | 66.01 | 52.88 |
| 8-110 | 74.04 | 67.58 |
| 8-110A | 83.07 | 69.12 |
| 8-111 | 78.51 | 71.18 |
| 8-111A | 94.48 | 80.06 |
| 8-112 | 93.18 | 94.16 |
| 8-112A | 90.42 | 85.42 |
| 8-113 | 93.22 | 90.81 |
| 8-113A | 89.30 | 87.53 |
| 8-113B | 82.41 | 73.62 |
| 8-114 | 74.81 | 64.41 |
| 8-114A | 84.18 | 71.63 |
| 8-115 | 95.14 | 80.05 |
| 8-115A | 93.37 | 81.24 |
| 8-115B | 80.69 | 61.22 |
| 8-118 | 93.28 | 83.59 |
| 8-119 | 89.65 | 76.60 |
| 8-120 | 96.80 | 87.03 |

EXAMPLE 6

The following cleaner/degreaser composition were prepared:

| | Product | | | | | |
|---|---|---|---|---|---|---|
| Component | 8-108 | 8-176A | 8-177 | 8-177A | 8-178 | 8-178A |
| Tap Water | 85.391 | 85.391 | 85.391 | 85.391 | 85.391 | 85.391 |
| Brilliant Blue | 0.002 | 0.002 | 0.002 | 0.002 | 0.002 | 0.002 |
| Neodol 1-9 | 3.0 | 3.0 | 3.0 | 3.0 | 3.0 | 3.0 |
| Neodol 1-3 | 2.0 | 2.0 | 2.0 | 2.0 | 2.0 | 2.0 |
| Alkali Surfactant NM | 1.0 | — | — | — | — | — |
| Isononanoic Acid | 0.5 | 0.5 | 0.5 | 0.5 | 0.5 | 0.5 |
| Sodium borate | 2.0 | 2.0 | 2.0 | 2.0 | 2.0 | 2.0 |
| Sodium imino-disuccinate | 5.0 | 5.0 | 5.0 | 5.0 | 5.0 | 5.0 |
| Sodium Nitrite | 0.6050 | 0.6050 | 0.6050 | 0.6050 | 0.6050 | 0.6050 |
| Triethanol-amine | 0.5020 | 0.5020 | 0.5020 | 0.5020 | 0.5020 | 0.5020 |
| Amphoteric 400 | — | 1.0 | — | — | — | — |
| AO-14-2 | — | — | 1.0 | — | — | — |
| Merataine ASC | — | — | — | 1.0 | — | — |
| Sod. 2-ethyl-hexyl sulfate | — | — | — | — | 1.0 | — |
| Sodium diiso-propyl-naphthalene-sulfonate | — | — | — | — | — | 1.0 |

In the above table, Amphoteric 400 is an iminodipropionate amphoteric surfactant supplied as a 50% solution of the partial sodium salt (Tomah Products, Inc.), AO-14-2 is an amphoteric ether amine oxide derived from a branched chain $C_{10}$ alcohol (Tomah Products, Inc.), Mirataine ASC is an amphoteric alkylether hydroxypropyl sultaine (Rhodia), sodium 2-ethylhexyl sulfate is an amphoteric surfactant available under the trade designation "Niaproof 8", and sodium diisopropylnaphthalenesulfonate is an amphoteric surfactant available under the trade designation "Naxan DSL" from Rutgers.

The above compositions were subjected to the soil removal tests set forth in Example 2 with the following results:

| 2 oz/gal | % Soil Removed | |
|---|---|---|
| Product | CSMA-Lt | CSMA-Hv |
| 8-108 | 79.43 | 66.91 |
| 8-176A | 80.80 | 76.02 |
| 8-177 | 76.75 | 68.40 |
| 8-177A | 73.47 | 64.28 |
| 8-178 | 71.64 | 54.74 |
| 8-178A | 66.55 | 51.46 |

EXAMPLE 7

The following cleaner/degreaser formulation was prepared:

| Component | Wt. % |
|---|---|
| Soft water | 86.0 |
| Sodium metasilicate | 3.0 |
| Sodium nitrite | 0.5 |
| Triethanolamine | 0.3 |
| Neodol 1-9 | 5.0 |
| Neodol 1-3 | 3.33 |
| Alkali Surfactant NM | |
| Fluorosurfactant (Zonyl NF) | 0.2 |

This formulation was compared to that sold under the trademark SHOPMASTER by Buckeye International, Inc. (and covered by U.S. Pat. No. 5,080,831 dated Jan. 14, 1992) in the following test procedures.

Two grease pencil marks were made on a painted desk top. Four drops of 32 oz/gal of water of SHOPMASTER were placed on one and four drops of 32 oz/gal of water of the above formulation were place on the other. After 10 minutes, there was no observable bleeding of grease pencil into the SHOPMASTER solution and, after 12 minutes, there was some observable bleeding into the solution. With the above formulation, there was observable bleeding into the solution after 4 minutes.

A beaker was filled with 100 ml of 32 oz/gal of SHOPMASTER and another was filled with 100 ml of 32 oz/gal of the above formulation. A grease covered engine part was placed in each solution and observed. After 5 minutes, there was slight oiling on the bottom of the beaker containing SHOPMASTER. After 6 hours, the engine part was removed. Some grease had been removed but none to bare metal. After 5 minutes, there was considerable oiling on the bottom of the beaker containing the above formulation. After 6 hours, the engine part was removed; about 75% of the grease had been removed to bare metal.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A cleaner or degreaser composition comprising a surfactant combination consisting of:

a) a water soluble ethoxylate selected from the group consisting of at least one linear primary or branched secondary alcohol of $C_9$ to $C_{15}$ chain length and 6 to 13 ethylene oxide groups/mole of alcohol;

b) a water insoluble ethoxylate selected from the group consisting of at least one linear primary or branched secondary alcohol of $C_9$ to $C_{15}$ chain length and 2.5 to 5 ethylene oxide groups/mole of alcohol; and c) a component selected from the group consisting of amphoteric surfactants, couplers and mixtures thereof;

said composition containing no alcohol, alkylphenol ethoxylate or glycol ether solvent.

2. A cleaner or degreaser composition as set forth in claim 1 wherein said water soluble ethoxylate comprises a linear primary alcohol of $C_{11}$ chain length and 9 ethylene oxide groups/mole of alcohol.

3. A cleaner or degreaser composition as set forth in claim 2 wherein said water insoluble ethoxylate comprises a linear primary alcohol of $C_{11}$ chain length and 3 ethylene oxide groups/mole of alcohol.

4. A cleaner or degreaser composition as set forth in claim 1 wherein said component is an amphoteric surfactant.

5. A cleaner or degreaser composition as set forth in claim 1 wherein said component is a mixture of an amphoteric surfactant and a coupler.

6. A cleaner or degreaser composition as set forth in claim 1 wherein said component is a coupler.

7. A cleaner or degreaser composition as set forth in claim 4 wherein said amphoteric surfactant is selected from the group consisting of isodecyloxypropylimino dipropionic acid monosodium salt, sodium iminodipropionate, alkylether hydroxypropyl sultaine, sodium 2-ethylhexyl sulfate and sodium diisopropylnaphthalenesulfonate.

8. A cleaner or degreaser composition as set forth in claim 7 wherein said amphoteric surfactant is isodecyloxypropylimino dipropionic acid monosodium salt.

9. A cleaner or degreaser composition as set forth in claim 1 wherein said coupler is selected from the group consisting of isononanoic acid, sodium cumene sulfonate and sodium xylene sulfonate.

10. A cleaner or degreaser composition as set forth in claim 1 wherein said water soluble ethoxylate comprises a linear primary alcohol of $C_{12-13}$ chain length and 6.5 ethylene oxide groups/mole of alcohol.

11. A cleaner or degreaser composition as set forth in claim 1 wherein said water insoluble ethoxylate comprises a linear primary alcohol of $C_{12-13}$ chain length and 3 ethylene oxide groups/mole of alcohol.

12. A cleaner or degreaser composition as set forth in claim 1 wherein said water soluble ethoxylate comprises a branched secondary alcohol of $C_{12-14}$ chain length and 9 ethylene oxide groups/mole of alcohol.

13. A cleaner or degreaser composition as set forth in claim 1 wherein said water insoluble ethoxylate comprises a branched secondary alcohol of $C_{12-14}$ chain length and 3 ethylene oxide groups/mole of alcohol.

14. A cleaner or degreaser composition as set forth in claim 5 wherein said amphoteric surfactant is isodecyloxypropylimino dipropionic acid said coupler is isononanoic acid.

15. A cleaner or degreaser composition as set forth in claim 1 wherein said water soluble ethoxylate comprises a linear primary alcohol of $C_{12-14}$ chain length and 9 ethylene oxide groups/mole of alcohol.

16. A cleaner or degreaser composition as set forth in claim 1 wherein the weight percent of said water soluble ethoxylate in said composition is less than twice the weight percent of said water insoluble ethoxylate.

17. A cleaner or degreaser composition as set forth in claim 1 wherein the composition contains three parts by weight of said water soluble ethoxylate to two parts by weight of said water insoluble ethoxylate.

* * * * *

UNITED STATES PATENT AND TRADEMARK OFFICE

CERTIFICATE OF CORRECTION

PATENT NO. : 6,716,804 B2
DATED : April 6, 2004
INVENTOR(S) : Gary Scherubel

It is certified that error appears in the above-identified patent and that said Letters Patent is hereby corrected as shown below:

Column 12,
Line 26, "acid said" should read -- acid monosodium salt and said --.

Signed and Sealed this

Twenty-third Day of November, 2004

JON W. DUDAS
*Director of the United States Patent and Trademark Office*